US011598338B2

(12) United States Patent
Choi et al.

(10) Patent No.: US 11,598,338 B2
(45) Date of Patent: Mar. 7, 2023

(54) COMPRESSOR

(71) Applicant: SAMSUNG ELECTRONICS CO., LTD., Suwon-si (KR)

(72) Inventors: Ho Choi, Hwaseong-si (KR); Hooi Joong Kim, Yongin-si (KR); Hong Taek Lim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 323 days.

(21) Appl. No.: 16/763,046

(22) PCT Filed: Sep. 13, 2018

(86) PCT No.: PCT/KR2018/010727
§ 371 (c)(1),
(2) Date: May 11, 2020

(87) PCT Pub. No.: WO2019/093647
PCT Pub. Date: May 16, 2019

(65) Prior Publication Data

US 2020/0386232 A1 Dec. 10, 2020

(30) Foreign Application Priority Data

Nov. 9, 2017 (KR) ..... 10-2017-0148815

(51) Int. Cl.
*F04C 29/06* (2006.01)
*G10K 11/16* (2006.01)

(52) U.S. Cl.
CPC ..... *F04C 29/065* (2013.01); *G10K 11/161* (2013.01); *F04C 2270/135* (2013.01)

(58) Field of Classification Search
CPC ..... F04C 29/06; F04C 29/00; F04C 29/065; F04C 29/068; F04C 29/061;
(Continued)

(56) References Cited

U.S. PATENT DOCUMENTS 6,398,520 B2 * 6/2002 Han ..... F04C 29/068 181/403
7,431,571 B2 * 10/2008 Kim ..... F04C 29/068 181/403
(Continued)

FOREIGN PATENT DOCUMENTS

CN 104088794 A 10/2014
CN 104500403 A * 4/2015 ..... F04C 29/06
(Continued)

OTHER PUBLICATIONS

Chinese Office Action dated Jun. 8, 2021 from Chinese Application No. 201880071378.7.
(Continued)

*Primary Examiner* — Edgardo San Martin
(74) *Attorney, Agent, or Firm* — Staas & Halsey LLP

(57) ABSTRACT

A compressor including a shaft, a flange to support shaft, and a muffler to reduce noise generated in a compression chamber of the compressor. The flange including a plurality of noise reductions units each of which is formed to have a different volume and at least a portion of the noise reduction unit is covered by the muffler.

10 Claims, 7 Drawing Sheets

(58) Field of Classification Search
CPC ..... F04C 2270/13; F04C 2270/135; F04C 2270/14; F04C 2270/145; G10K 11/161; G10K 11/172
See application file for complete search history.

(56) References Cited

U.S. PATENT DOCUMENTS

| | | | | |
|---|---|---|---|---|
| 7,604,466 | B2 * | 10/2009 | Dreiman | F04C 29/065 181/403 |
| 9,951,775 | B2 * | 4/2018 | Katayama | F04C 18/3562 |
| 10,731,650 | B2 * | 8/2020 | Ku | F04C 18/3564 |
| 11,326,605 | B2 * | 5/2022 | Lee | F04C 18/3564 |
| 2021/0363994 | A1 * | 11/2021 | Nam | F01C 21/108 |
| 2022/0034324 | A1 * | 2/2022 | Lee | F04C 29/12 |

FOREIGN PATENT DOCUMENTS

| | | | | | |
|---|---|---|---|---|---|
| CN | 111765086 | A | * | 10/2020 | |
| EP | 3502476 | B1 | * | 3/2020 | F04C 18/356 |
| JP | 2000179458 | A | * | 6/2000 | |
| JP | 2000-204922 | | | 7/2000 | |
| KR | 10-1999-0047609 | | | 7/1999 | |
| KR | 1999-0047609 | | | 7/1999 | |
| KR | 19990023039 | U | * | 7/1999 | F04C 29/06 |
| KR | 2000-0019544 | | | 4/2000 | |
| KR | 10-2000-0056333 | | | 9/2000 | |
| KR | 2000-0056333 | | | 9/2000 | |
| KR | 10-0286310 | B1 | | 5/2001 | |
| KR | 20010046224 | A | * | 6/2001 | F04B 39/00 |
| KR | 2001-0063936 | A | | 7/2001 | |
| KR | 20020001029 | A | * | 1/2002 | F04B 39/00 |
| KR | 10-2007-0000541 | | | 1/2007 | |
| KR | 100747564 | B1 | * | 8/2007 | F04C 29/06 |
| KR | 20180104871 | A | * | 9/2018 | F04C 18/02 |

OTHER PUBLICATIONS

Chinese Office Action dated Dec. 23, 2021 from Chinese Application No. 201880071378.7.

Korean Office Action dated Oct. 29, 2021 from Korean Application No. 10-2017-0148815.

International Search Report dated Jan. 17, 2019, in corresponding International Patent Application No. PCT/KR2018/010727.

* cited by examiner

COMPRESSOR

CROSS-REFERENCE TO RELATED APPLICATIONS

This application is a U.S. National Stage Application which claims the benefit under 35 U.S.C. § 371 of International Patent Application No. PCT/KR2018/010727 filed on Sep. 13, 2018, which claims foreign priority benefit under 35 U.S.C. § 119 of Korean Patent Application No. 10-2017-0148815 filed on Nov. 9, 2017 in the Korean Intellectual Property Office, the contents of both of which are incorporated herein by reference.

TECHNICAL FIELD

Embodiments of the present disclosure relate to a compressor, and more particularly, to a structure capable of reducing noise of a rotary compressor.

BACKGROUND ART

In general, a compressor applied to a refrigeration cycle of a refrigerator or an air conditioner includes a hermetically sealed container forming an outer appearance, a compression unit for compressing a refrigerant inside the hermetically sealed container, and a drive unit for providing compression power according to the compression of the refrigerant. One side and the other side of the hermetically sealed container are provided with a suction pipe for guiding the external refrigerant to the inside of the hermetically sealed container and a discharge pipe for discharging the refrigerant compressed by the compression unit to the outside of the hermetically sealed container, respectively. The compressor is provided with a muffler for reducing noise generated when the refrigerant is discharged.

In order to reduce noise generated when the compressed refrigerant is discharged from a compression chamber of the compressor, the shape of the conventional muffler and the number of discharge holes need to-be changed or a resonator needs to be applied to the inside of a cylinder.

DISCLOSURE

Technical Problem

Therefore, it is an aspect of the present disclosure to provide an improved compressor capable of reducing noise in a wide frequency band.

It is another aspect of the present disclosure to provide a compressor with improved noise reduction without additional components.

Technical Solution

In accordance with one aspect of the present disclosure, a compressor includes: a shaft; a flange to support the shaft; a cylinder including a compression chamber in which the shaft is inserted and rotated to suck and compress the refrigerant; and a muffler to reduce noise generated in the compression chamber and having a contact surface therearound so as to be coupled to the flange, wherein the flange includes a plurality of noise reduction units each of which is formed to have a different volume, and at least a portion of the noise reduction unit is covered by the contact surface.

The noise reduction unit may include: a connecting portion and a volume portion connected to the connecting portion.

The volume portion may be covered by the contact surface.

The connecting portion may be spaced apart from the muffler.

The connecting portion may extend radially inward from the volume portion.

The connecting portions of the plurality of noise reduction units may be formed in different sizes and shapes.

The volume portions of the plurality of noise reduction units may be formed in different lengths.

The volume portions of the plurality of noise reduction units may be formed in different heights.

The volume portions of the plurality of noise reduction units may be formed in different shapes.

The volume portions of the plurality of noise reduction units may be formed in one of a quadrangle, a circle, and an ellipse shape The plurality of noise reduction units may be formed by recessing at least one surface of the flange.

The plurality of noise reduction units may be disposed spaced apart from each other.

In accordance with one aspect of the present disclosure, a compressor includes: a cylinder provided with a compression chamber for sucking and compressing the refrigerant; a flange provided on the upper and lower portions of the cylinder; and a muffler installed on the flange to reduce noise generated in the compression chamber, wherein the flange includes a plurality of volume portions formed in different volumes and a plurality of connecting portions extending from the plurality of volume portions, wherein at least one surface of the plurality of volume portions is covered by the rim of the muffler.

The plurality of connecting portions may be spaced apart from the muffler.

The muffler may include a contact surface therearound so as to be coupled to the flange, and the plurality of volume portions are covered by the contact surface.

The plurality of connecting portions may be formed in different sizes and shapes.

The plurality of volume portions may be formed in different lengths.

The plurality of volume portions may be formed in different heights.

The plurality of volume portions may be formed in different shapes.

The plurality of volume portions may be formed in one of a quadrangle, a circle, and an ellipse shape.

Advantageous Effects

According to the embodiment of the present disclosure, noise reduction can be improved without additional components.

In addition, noise in a wide frequency band can be reduced.

BEST MODE

The terms "front," "rear," "upper," and "lower" used in the following description are defined with reference to the drawings, and the shape and position of each component are not limited by these terms.

Hereinafter, the embodiments of the present disclosure will be described in detail with reference to the accompanying drawings.

Figure 1:
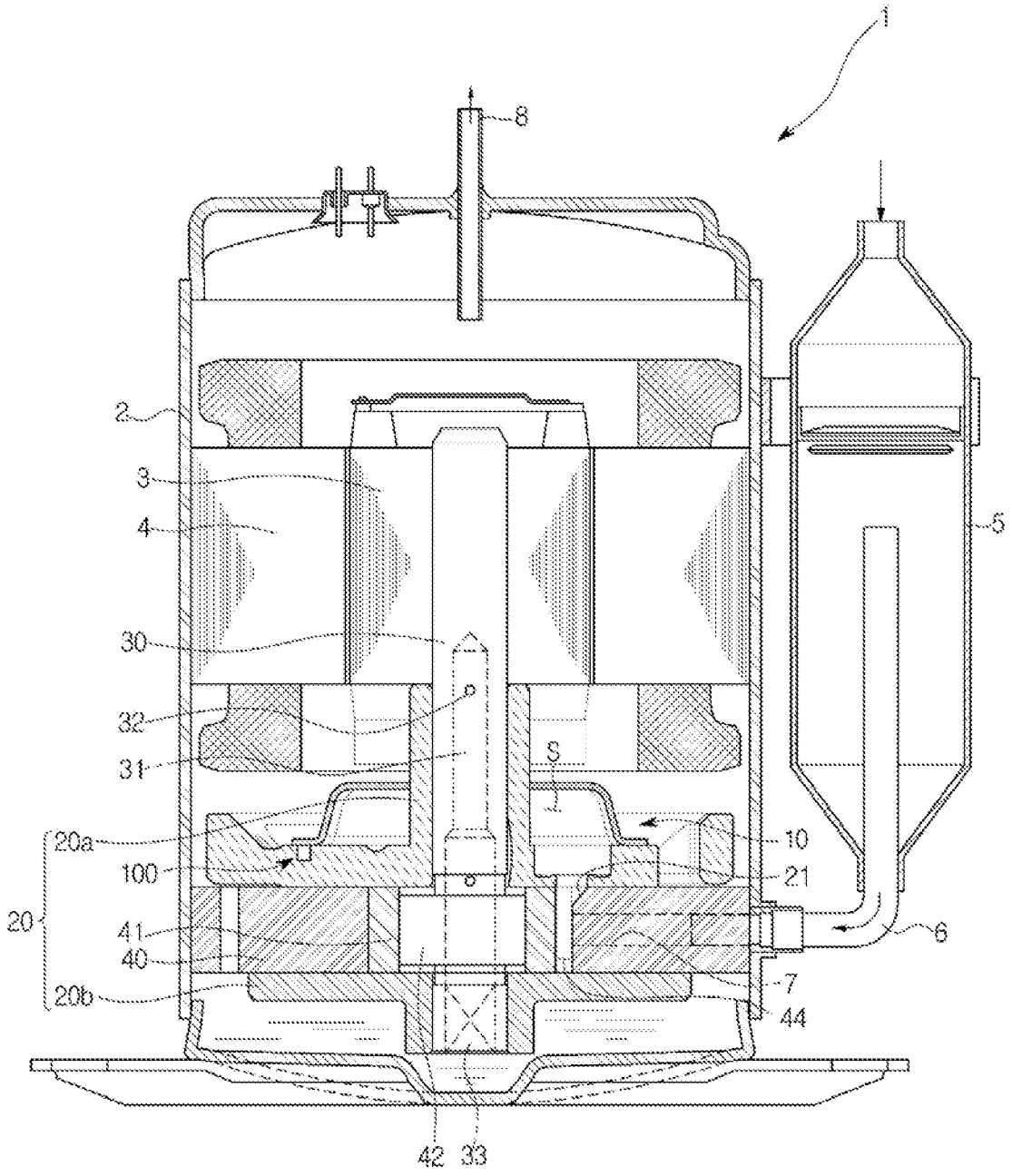
FIG. 1 is a cross-sectional view illustrating a rotary compressor according to one embodiment of the present disclosure.

FIG. 1 is a cross-sectional view illustrating a rotary compressor according to one embodiment of the present disclosure.

As shown in FIG. 1, a rotary compressor 1 includes a sealed case 2, a stator 4 and a rotor 3 provided at the upper inside of the case 2, and a shaft 30 coupled to the center of the rotor 3. The rotor 3 is provided so as to be rotated by a magnetic field of the stator 4 to provide compression power according to the compression of the refrigerant.

An accumulator 5 is provided on one side of the case 2. The accumulator 5 is connected to a cylinder 40 by a suction pipe 6. The accumulator 5 stores the liquid refrigerant so that the liquid refrigerant generated by the load fluctuation due to the suction of the refrigerant is not introduced into the cylinder 40 of the compressor 1.

A refrigerant discharge pipe 8 for discharging the compressed fluid and the refrigerant gas to the outside of the case 2 is provided in the upper portion of the case 2 and a certain amount of oil is stored for lubrication and cooling of the frictional member in the lower portion of the case 2.

A cam 42 and a roller 41 are provided on the lower side of the shaft 30 and the cam 42 and the roller 41 are inserted and installed inside the cylinder 40 to compress the refrigerant.

An oil passage 31 is formed on the inner side of the shaft 30 and an oil pick-up member 33 to raise and supply the oil stored in the lower portion of the case 2 to the inside of the cylinder 40 and the inside of a flange 20 is inserted into the lower end of the shaft 30. An oil hole 32 is formed on the upper side of the oil passage 31 so that the oil flows to the outer peripheral surface of the shaft 30.

An upper flange 20*a* and a lower flange 20*b* to support the cylinder 40 are fastened to the cylinder 40 by fastening members 50 at upper and lower portions of the cylinder 40. Hereinafter, the flange 20 refers to the upper flange 20*a*.

The upper portion of the flange 20 is provided with a muffler 10 for reducing the noise of the refrigerant gas generated in the process of being compressed in the cylinder 40 and discharged through a cylinder discharge port 21. In the embodiment of the present disclosure, the muffler 10 is installed on the upper portion of the cylinder 40, but the spirit of the present disclosure is not limited thereto. For example, the muffler may be installed at the top and bottom of the flange, respectively.

The rotor 3 and the shaft 30 are rotated by a magnetic field formed as a current is applied to the stator 4 and the cam 42 and the roller 41, which rotate integrally with the shaft 30, are eccentrically rotated. As the cam 42 and the roller 41 are eccentrically rotated, a vane 46 slidingly contacts the outer circumferential surface of the roller 41 by an elastic force of a spring 45 and divides the space in the cylinder 40 into the suction chamber and a compression chamber 44.

That is, the vane 46 is provided between a suction port 7 to which the suction pipe 6 is connected and the cylinder discharge port 21 of the cylinder 40. When the cam 42 rotates toward the cylinder discharge port 21, a suction force is generated and the refrigerant is sucked through the suction port 7 through the suction pipe 5 and the suction pipe 6 by the suction force and the high temperature and high pressure refrigerant is discharged through the cylinder discharge port 21 of the cylinder 40.

The muffler 10 reduces the noise generated in the process of discharging the high-temperature and high-pressure refrigerant through the cylinder discharge port 21 of the cylinder 40.

The flange 20 is provided with a noise reduction unit 100. The noise reduction unit 100 may be provided between the flange 20 and the muffler 10. At least a portion of the noise reduction unit 100 may be covered by the muffler 10.

Figure 2:
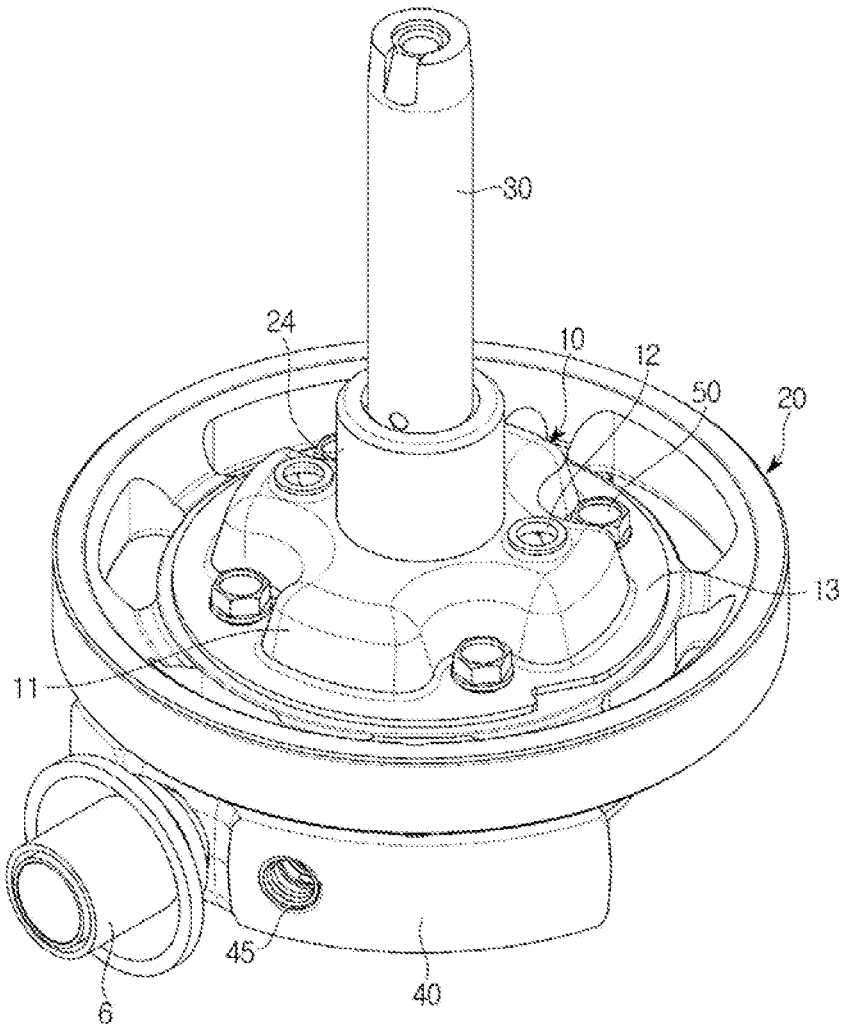
FIG. 2 is a perspective view illustrating the rotary compressor to which a noise reduction unit is applied according to one embodiment of the present disclosure.
Figure 3:
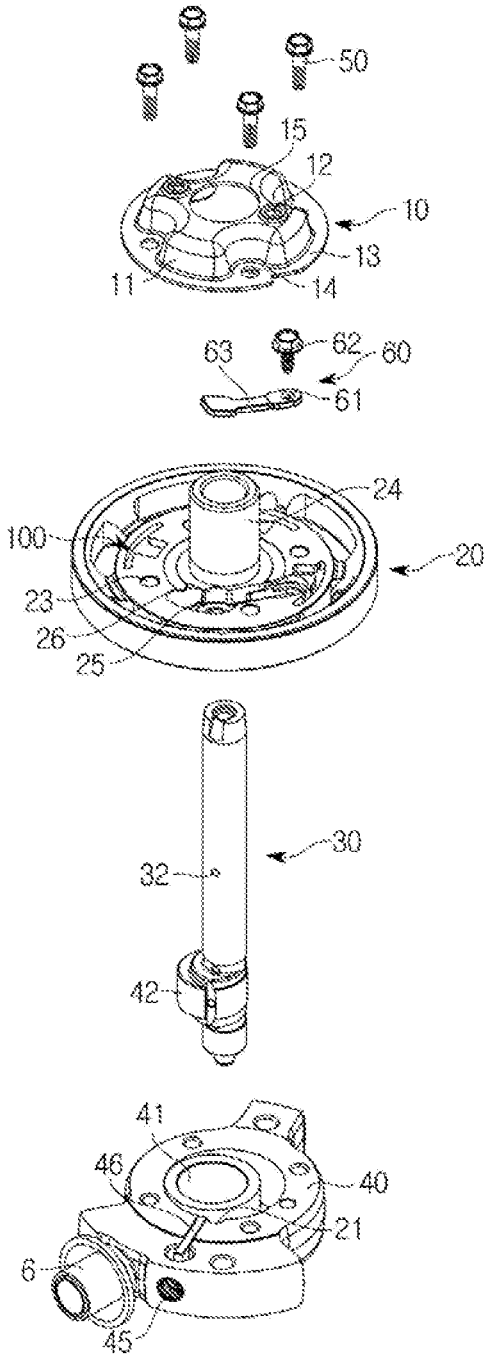
FIG. 3 is an exploded perspective view illustrating the rotary compressor to which the noise reduction unit is applied according to one embodiment of the present disclosure.
Figure 4:
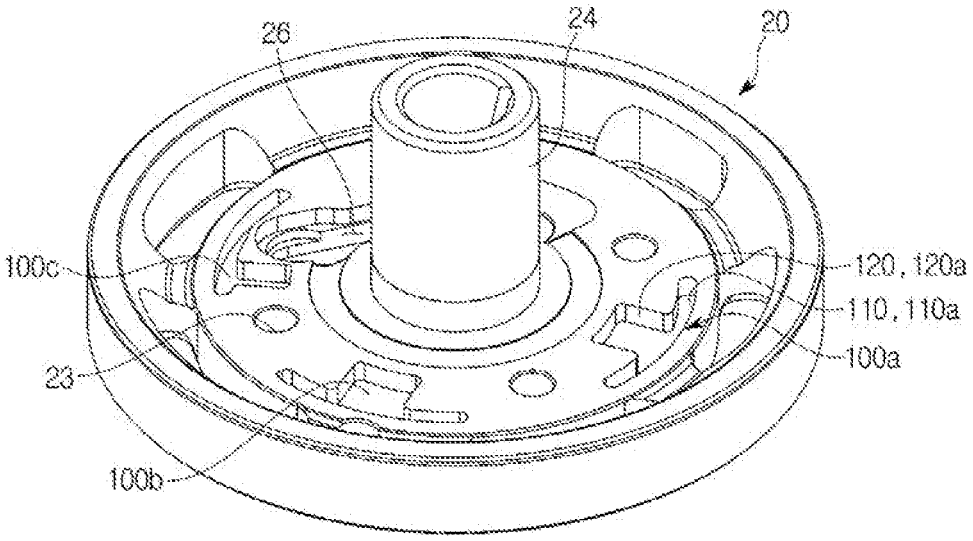
FIG. 4 is perspective view illustrating a flange to which the noise reduction unit is applied according to one embodiment of the present disclosure.
Figure 5:
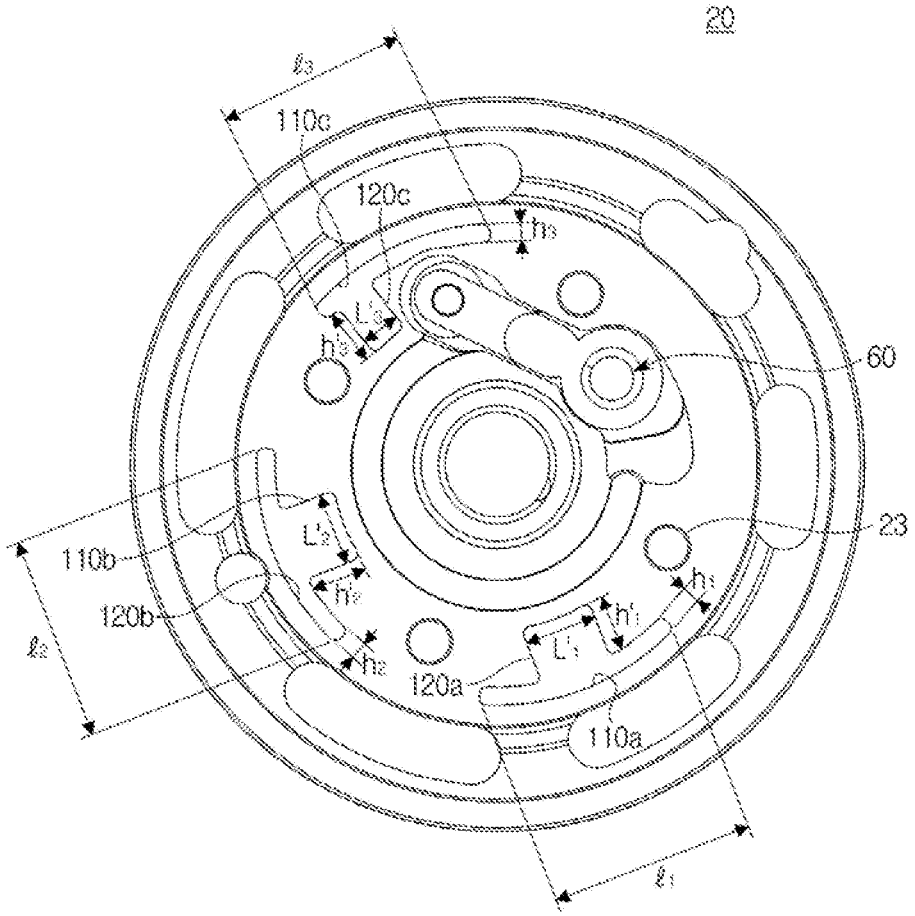
FIG. 5 is a front view illustrating the flange to which the noise reduction unit is applied according to one embodiment of the present disclosure.
Figure 6:
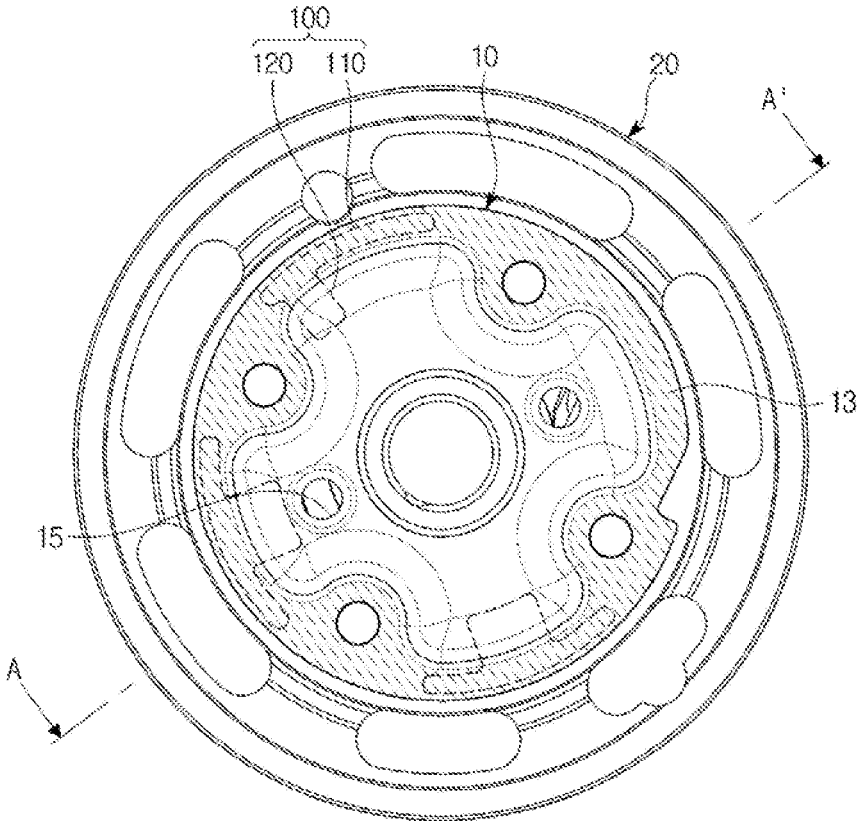
FIG. 6 is a view illustrating a combination of a muffler and the flange to which the noise reduction unit is applied according to one embodiment of the present disclosure.
Figure 7:
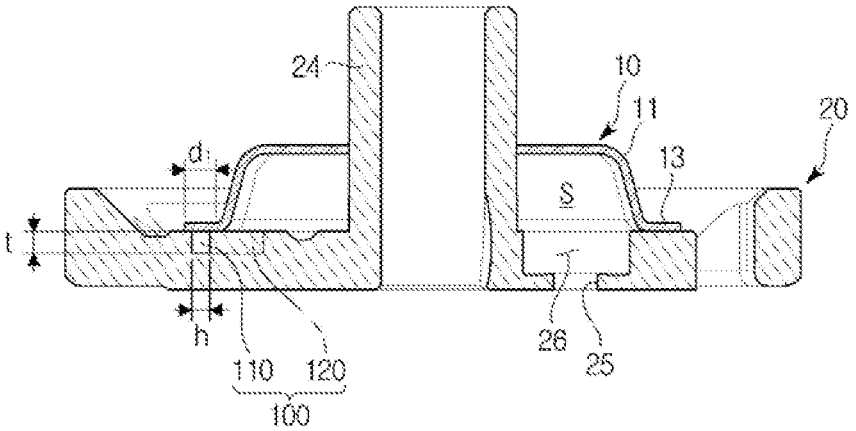
FIG. 7 is a cross-sectional view taken along line A-A' of FIG. 6, which shows the noise reduction unit according to one embodiment of the present disclosure.

FIG. 2 is a perspective view illustrating the rotary compressor to which a noise reduction unit is applied according to one embodiment of the present disclosure, FIG. 3 is an exploded perspective view illustrating the rotary compressor to which the noise reduction unit is applied according to one embodiment of the present disclosure, FIG. 4 is perspective view illustrating a flange to which the noise reduction unit is applied according to one embodiment of the present disclosure, FIG. 5 is front view illustrating the flange to which the noise reduction unit is applied according to one embodiment of the present disclosure, FIG. 6 is a view illustrating a combination of a muffler and the flange to which the noise reduction unit is applied according to one embodiment of the present disclosure, and FIG. 7 is a cross-sectional view taken along line A-A' of FIG. 6, and is a cross-sectional view illustrating the noise reduction unit according to one embodiment of the present disclosure.

As shown in FIG. 2 to FIG. 7, the muffler 10 of the compressor 1 is provided to be coupled to the flange 20.

The muffler 10 includes a muffler body 11 in which a discharge space S through which the refrigerant compressed in the compression chamber 44 is discharged is formed and a contact surface 13 formed at the rim of the muffler body 11 for coupling the flange 20.

The contact surface 13 of the muffler 10 is formed at the outer edge of the muffler body 11. Fastening holes 14 for fastening with the flange 20 are formed at the contact surface 13 at predetermined intervals. The muffler 10 may be fastened by the fastening members 50 passing through the fastening holes 14. The fastening members 50 passing through the fastening holes 14 of the muffler 10 may be coupled to bolt coupling holes 23 of the flange 20.

A shaft through hole 15 is formed in the center of the muffler body 11 so that a shaft supporting portion 24 provided in the flange 20 is formed to penetrate through the muffler body 11 so as to support the shaft 30.

The muffler body 11 is provided with discharge ports 12 arranged symmetrically with respect to the shaft through hole 15. The discharge port 12 causes the oil and oil mucilage contained in the refrigerant compressed in the cylinder 40 to be ejected toward the shaft 30.

The flange 20 is formed in a disk shape. The flange 20 includes the bolt coupling holes 23 corresponding to the fastening holes 14 of the muffler 10. The bolt coupling holes 23 may include a groove or a hole. The hollow shaft supporting portion 24 is provided at the center of the flange 20 so as to protrude upward to support the shaft 30. The bolt coupling holes 23 may be arranged symmetrically with respect to the shaft supporting portion 24 at four positions.

The flange 20 may include a valve 60. The valve 60 may be installed in a valve mounting portion 26 of the flange 20. The valve mounting portion 26 is formed with a flange discharge port 25 formed at a position corresponding to the cylinder discharge port 21.

The valve 60 includes a valve plate 63, a valve fixing hole 61 provided at one side of the valve plate 63 and a valve fixing member 62 which is fastened to the valve mounting portion 26 of the flange 20 through the valve fixing hole 61. The valve plate 63 is provided so as to correspond to the valve mounting portion 26. The valve plate 63 is provided at a position corresponding to the cylinder discharge port 21 and the flange discharge port 25 of the cylinder 40.

When the refrigerant gas compressed in the compression chamber 44 formed in the cylinder 40 reaches a predetermined pressure or more, the refrigerant gas pushes the valve plate 63 through the cylinder discharge port 21 and discharged to the flange discharge port 25. When the pressure of the refrigerant compressed in the compression chamber 44 drops, the valve plate 63 is closed by the elastic force of the valve 60

The refrigerant gas discharged through the valve 60 may be introduced into the discharge space S of the muffler 10.

The flange 20 includes a plurality of the noise reduction units 100. The noise reduction units 100 may be disposed on the upper surface of the flange 20 at a predetermined distance. The noise reducing units 100 may be formed on the upper surface of the flange 20 by being recessed. The noise reduction units 100 may be disposed between the bolt coupling holes 23.

The noise reduction units 100 are formed to have different volumes. At least a portion of the noise reduction units 100 may be covered by the contact surface 13 of the muffler 10. The noise reduction unit 100 includes a connecting portion 120 provided for inflow of a specific frequency pulsation of the refrigerant and a volume portion 110 provided to reduce the pulsation of the frequency of the refrigerant introduced through the connecting portion 120.

The volume portion 110 of the noise reduction unit 100 is covered by the contact surface 13 of the muffler 10. The connecting portion 120 of the noise reduction unit 100 is formed to extend from the volume portion 110 toward the center of the flange 20. An upper surface of the volume portion 110 is covered by the contact surface 13 of the muffler 10. The upper surface of the volume portion 110 is formed by the contact surface 13 of the muffler 10. The connecting portion 120 is formed spaced apart from the muffler 10. The connecting portion 120 is formed spaced apart from the muffler body 11.

The volume portion 110 of the noise reduction unit 100 may be formed with a length 1, a height h, and a width t. At this time, it is preferable that the height h of the volume portion 110 is formed to be smaller than a contact surface length dl of the muffler 10. The height h of the volume portion 110 is formed to be smaller than the contact surface length dl so that the upper surface of the volume portion 110 is covered by the contact surface 13 of the muffler 10 to reduce the pulsation of the refrigerant introduced through the connecting portion 120.

The noise reduction unit 100 is formed in a resonator shape by the connecting portion 120 and the volume portion 110 formed on the flange 20 so that noise in a frequency band other than the existing frequency band can be reduced.

The noise reduction unit 100 includes a first noise reduction unit 100*a*, a second noise reduction unit 100*b*, and a third noise reduction unit 100*c*, each having a different volume. The first noise reduction unit 100*a*, the second noise reduction unit 100*b*, and the third noise reduction unit 100*c* are spaced apart from each other. Although the noise reduction unit 100 includes three noise reduction units in this embodiment, the spirit of the present disclosure is not limited thereto. For example, the number of noise reduction units may be variously formed.

The volume portions 110 of the respective noise reduction units 100 may be formed in different sizes. The volume portions 110 of the respective noise reduction units 100 may be formed in different shapes. The volume portions 110 of the respective noise reduction units 100 may include a different length 1 and height h. The volume portion 110 of the noise reduction unit 100 may include at least one of a quadrangle, a circle, and an ellipse. In the embodiment of the present disclosure, the volume portion 110 is formed in a slit shape and the connecting portion 120 is formed in a rectangular shape, for example, but the spirit of the present disclosure is not limited thereto.

For example, the first noise reduction unit 100*a* includes a first volume portion 110*a* and a first connecting portion 120*a*. The first volume portion 110*a* may include a first length 11 and a first height h1. The second noise reduction unit 100*b* includes a second volume portion 110*b* and a second connecting portion 120*b*. The second volume portion 110*b* may include a second length 12 and a second height h2. The third noise reduction unit 100*c* includes a third volume portion 110*c* and a third connecting portion 120*c*. The third volume portion 110*c* may include a third length 13 and a third height h3.

The first length 11, the second length 12, and the third length 13 of the first volume portion 110*a* may be different from each other. The first height h1, the second height h2 and the third height h3 of the first volume portion 110*a* may be different from each other.

In the embodiment of the present disclosure, the thicknesses of the first volume portion 110*a*, the second volume portion 110*b*, and the third volume portion 110*c* may be the same, but the spirit of the present disclosure is not limited thereto. For example, the thicknesses of the respective volume portions of the noise reduction units may have different values.

In addition, a first length L'), a second length L'2, and a third length L'3 of the first connection portion 120*a* may be different from each other. A first height h'1, a second height h'2, and a third height h'3 of the first volume portion 110*a* may be different from each other.

It is possible to reduce the noise of different frequency bands and reduce the noise of wide frequency by the connecting portion 120 and the volume portion 110 of the noise reduction unit formed in different volumes.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A compressor comprising:

a shaft;

a flange to support the shaft;

a cylinder including a compression chamber in which the shaft is insertable and rotatable to suck and compress the refrigerant; and a muffler to reduce noise generated in the compression chamber and having a contact surface at a circumference of the muffler so as to be coupled to the flange, wherein the flange includes a plurality of noise reduction units, each of which is formed to have a different volume, and each of the plurality of noise reduction units includes:

a connecting portion through which refrigerant with a specific frequency pulsation flows in, and a volume portion connected to the connecting portion, and where the volume portion is covered by the contact surface.

2. The compressor according to claim 1, wherein each connecting portion of the plurality of noise reduction units are spaced apart from the muffler.

3. The compressor according to claim 1, wherein each connecting portion of the plurality of noise reduction units extends radially inward from each volume portion of the plurality of noise reduction units, respectively.

4. The compressor according to claim 1, wherein each connecting portion of the plurality of noise reduction units are formed in different sizes and shapes.

5. The compressor according to claim 1, wherein each volume portion of the plurality of noise reduction units are formed in different lengths (l).

6. The compressor according to claim 1, wherein each volume portion of the plurality of noise reduction units are formed in different heights (h).

7. The compressor according to claim 1, wherein each volume portion of the plurality of noise reduction units are formed in different shapes.

8. The compressor according to claim 1, wherein each volume portion of the plurality of noise reduction units are formed in one of a quadrangle, a circle, and an ellipse shape.

9. The compressor according to claim 1, wherein the plurality of noise reduction units are formed by recessing at least one surface of the flange.

10. The compressor according to claim 1, wherein the plurality of noise reduction units are disposed spaced apart from each other.

* * * * *